US006308784B1

(12) United States Patent
Mears

(10) Patent No.: US 6,308,784 B1
(45) Date of Patent: Oct. 30, 2001

(54) FLUSH SPRINKLER

(75) Inventor: James W. Mears, Warwick, RI (US)

(73) Assignee: Grinnell Corporation, Cranston, RI (US)

( * ) Notice: Subject to any disclaimer, the term of this patent is extended or adjusted under 35 U.S.C. 154(b) by 0 days.

(21) Appl. No.: 09/519,696

(22) Filed: Mar. 7, 2000

(51) Int. Cl.[7] ..... A62C 37/11
(52) U.S. Cl. ..... 169/37
(58) Field of Search ..... 239/37, 38, 40

(56) References Cited

U.S. PATENT DOCUMENTS

| | | | | |
|---|---|---|---|---|
| 4,618,002 | | 10/1986 | Mears . | |
| 4,651,832 | | 3/1987 | Kubo . | |
| 4,715,447 | | 12/1987 | Johnson . | |
| 4,785,888 | | 11/1988 | Blum et al. . | |
| 4,976,320 | | 12/1990 | Polan . | |
| 4,977,963 | | 12/1990 | Simons . | |
| 5,083,616 | | 1/1992 | Polan . | |
| 5,094,298 | | 3/1992 | Polan . | |
| 5,159,984 | | 11/1992 | Hattori . | |
| 5,184,683 | | 2/1993 | Takamasa . | |
| 5,234,059 | | 8/1993 | Eynon . | |
| 5,299,645 | | 4/1994 | Hoening et al. . | |
| 5,613,563 | | 3/1997 | Johnson . | |
| 5,667,017 | * | 9/1997 | Hoffmann et al. | 169/38 |
| 6,152,236 | * | 11/2000 | Retzloff et al. | 169/57 |

OTHER PUBLICATIONS

Viking Technical Data: Horizon Model H Standard Response Flush Pendent Sprinkler, *The Viking Corporation*, 2 pages (Nov. 7, 1996).

Central Omega C–1 A Quick Response Commercial Automatic Sprinkler, *Central Sprinkler Company*, 4 pages (1998).

Reliable Model ZX–1 Quick Response Pendent Horizontal Sidewall Automatic Sprinkler, *The Reliable Automatic Sprinkler Co., Inc.*, 4 pages (Mar. 1996).

Star Celeste Model S150 Flush Pendent Sprinkler, *Star Sprinkler Inc.*, 2 pages (May 1997).

Star Quick Response, Std. Coverage Flush Pendent Sprinklers Celeste S140, *Star Sprinkler Inc.*, 2 pages, (Oct. 1998).

* cited by examiner

*Primary Examiner*—Lesley D. Morris
(74) *Attorney, Agent, or Firm*—Fish & Richardson P.C.

(57) ABSTRACT

A flush fire protection sprinkler has a body with an outlet for delivering fire protection fluid under pressure. The body defines a seat about the outlet and a coaxial rim with an inner lip. A spring seal engages upon the seat. A thermal response assembly includes a plate with a conical rim having slots extending from the rim edge, a retainer having a hub and fingers terminating in fingertips defining engagement structure, the fingers engaging in the slots with the fingertips outside the rim, a thermal response element between the plate and hub, and a loading element mounted to the hub. Initial adjustment of the loading element draws the hub away from the plate, with the rim surface urging the fingertips outward, to engage with the lip. Further adjustment pressures the seal in sealing engagement upon the seat. The thermal response element, in a fire condition, actuates, and fire protection fluid flow urges the plate away from the outlet, permitting the fingers to contract inward, disengaging from the lip, and the thermal response assembly disengages from the body and moves away from the outlet.

39 Claims, 6 Drawing Sheets

FLUSH SPRINKLER

TECHNICAL FIELD

This invention relates to fire protection sprinklers.

BACKGROUND

For reasons of aesthetics and architectural design, flush fire protection sprinklers are designed so that only the thermally responsive element is exposed within the room. The rest of the structure is hidden above the ceiling (pendant-type flush fire protection sprinklers) or behind the wall (horizontal sidewall-type flush fire protection sprinklers). When the sprinkler is actuated, a deflector, hidden from view in the standby condition of the fire protection sprinkler, moves from a retracted position to an extended, fixed condition within the room to deflect water flowing from the sprinkler orifice over the area to be protected.

SUMMARY

According to one aspect of the invention, a flush fire protection sprinkler comprises a body defining a passage having an inlet for connection to a source of fire protection fluid under pressure and an outlet for delivery of fire protection fluid toward a region to be protected, the body defining a seat about the outlet and a rim coaxial with the outlet and having an inner circumferential lip, the flush fire protection sprinkler having a first, standby condition with the outlet closed to flow and a second, active condition with the outlet open to flow; a sealing member engaged upon the seat; and a thermally responsive element assembly, comprising: a plate member having a conical upstanding rim extending radially outward in the direction of fire protection fluid flow from the outlet and defining a plurality of slots extending radially inward from an outer edge of the conical, upstanding rim, a retaining member having a hub and a plurality of elongated retainer fingers terminating in enlarged fingertip portions defining an engagement structure, the elongated retainer fingers having a radially inward bias, toward a hub axis, and engaged in the plurality slots, with the enlarged fingertip portions disposed radially outside an outer surface of the conical, upstanding rim, a thermally responsive element disposed between the plate member and the hub, the thermal responsive element adapted to actuate in response to a heat condition above a predetermined temperature, and a pressure adjustment element mounted to the hub for applying pressure to the thermally responsive element, initial adjustment of the pressure loading element drawing the hub relatively away from the plate member, with the outer surface of the conical upstanding rim urging the enlarged fingertip portions of the elongated retainer fingers radially outward to bring the engagement structure of the enlarged fingertip portions into engagement with the inner circumferential lip, further adjustment of the pressure loading element pressuring the sealing member in sealing engagement upon the seat. The thermally responsive element, in a heat condition above the predetermined temperature, is adapted to actuate to allow pressure of fire protection fluid flow from the outlet to urge the plate member away from the outlet, permitting the elongated retainer fingers to contract toward the hub axis under the radially inward bias, disengaging the engagement structure of the enlarged fingertip portions from the inner circumferential lip, the thermally responsive element assembly thus disengaging from the body to move away from the outlet.

According to another aspect of the invention, a flush fire protection sprinkler comprises a body defining a passage having an inlet for connection to a source of fire protection fluid under pressure and an outlet for delivery of fire protection fluid toward a region to be protected, the body defining a seat about the outlet, the flush fire protection sprinkler having a first, standby condition with the outlet closed to flow and a second, active condition with the outlet open to flow, a sealing member engaged upon the seat, and a thermally responsive element assembly, comprising a spring member having a plurality of elongated retainer fingers retaining a thermally responsive element adapted to actuate in response to a heat condition above a predetermined temperature, the thermally responsive element, in a heat condition above the predetermined temperature, adapted to actuate to permit the elongated retainer fingers to disengage from the body to move away from the outlet, releasing the sealing member from engagement upon the seat.

Preferred embodiments of both of these aspects of the invention may include one or more of the following additional features. The flush fire protection sprinkler further comprises a deflector mounted to the body, the deflector, in the standby condition of the flush fire protection sprinkler, being positioned to urge the sealing member into sealing engagement upon the seat, and the deflector, in the active condition of the flush fire protection sprinkler, being positioned to deflect flow of fire protection fluid from the outlet over an area of the region to be protected. Preferably, the deflector is mounted upon deflector arms disposed in sliding engagement with the body. The sealing member is spring sealing member, e.g. a Belleville washer-type spring sealing member, preferably with resilient coating of PTFE, which, upon actuation of the thermally responsive element, urges the plate member away from the outlet. The plurality of elongated retainer fingers comprises three elongated retainer fingers. The plate member and/or retaining member are metal stampings, formed of a non-corrosive material, e.g. stainless steel. Preferably, the retaining member is spring tempered. The thermally responsive element is a frangible bulb adapted, in a heat condition above the predetermined temperature, to burst to allow pressure of fire protection fluid flow from the outlet. The engagement structure comprises a pierced tab, a bent lip, double tabs, and/or formed corners. The flush fire protection sprinkler has a configuration for mounting as a pendent-type fire protection sprinkler, or for mounting as a sidewall horizontal-type fire protection sprinkler, preferably further comprising a generally horizontal shelf deflector element.

According to still another aspect of the invention, a flush fire protection sprinkler comprises a body defining a passage having an inlet for connection to a source of fire protection fluid under pressure and an outlet for delivery of fire protection fluid toward a region to be protected, the body defining a seat about the outlet and a rim coaxial with the outlet and having an inner circumferential lip, the flush fire protection sprinkler having a first, standby condition with the outlet closed to flow and a second, active condition with the outlet open to flow; a sealing member engaged upon the seat; a deflector mounted to the body, the deflector, in the standby condition of the flush fire protection sprinkler, being positioned to urge the sealing member into sealing engagement upon the seat, and the deflector, in the active condition of the flush fire protection sprinkler, being positioned to deflect flow of fire protection fluid from the outlet over an area of the region to be protected; and a thermally responsive element assembly, comprising: a plate member having a conical upstanding rim extending radially outward in a direction of fire protection fluid flow from the outlet and defining a plurality of slots extending radially inward from an outer edge of the conical, upstanding rim, a retaining member having a hub and a plurality of elongated retainer fingers terminating in enlarged fingertip portions defining an engagement structure, the elongated retainer fingers having a radially inward bias, toward a hub axis, and engaged in the plurality slots, with the enlarged fingertip portions disposed radially outside an outer surface of the conical, upstanding rim, a thermally responsive element disposed between the plate member and the hub, the thermal responsive element adapted to actuate in response to a heat condition above a predetermined temperature, and a pressure loading element mounted to the hub for applying pressure to the thermally responsive element, initial adjustment of the pressure loading element drawing the hub relatively away from the plate member, with the outer surface of the conical upstanding rim urging the enlarged fingertip portions of the elongated retainer fingers radially outward to bring the engagement structure of the enlarged fingertip portions into engagement with the inner circumferential lip, further adjustment of the pressure loading element pressuring the sealing member in sealing engagement upon the seat. The thermally responsive element, in a heat condition above the predetermined temperature, is adapted to actuate to allow pressure of fire protection fluid flow from the outlet to urge the plate member away from the outlet, permitting the elongated retainer fingers to contract toward the hub axis under the radially inward bias, disengaging the engagement structure of the enlarged fingertip portions from the inner circumferential lip, the thermally responsive element assembly thus disengaging from the body to move away from the outlet.

Objectives of the invention include: to provide a flush fire protection sprinkler that utilizes a novel loading and release mechanism using a minimum number of parts, including inexpensive metal stampings, that displays the bulb in its optimum orientation to air currents for fast response, that offers relatively unobstructed air flow past the bulb, and/or that presents a clean and unobtrusive appearance for aesthetic purposes.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
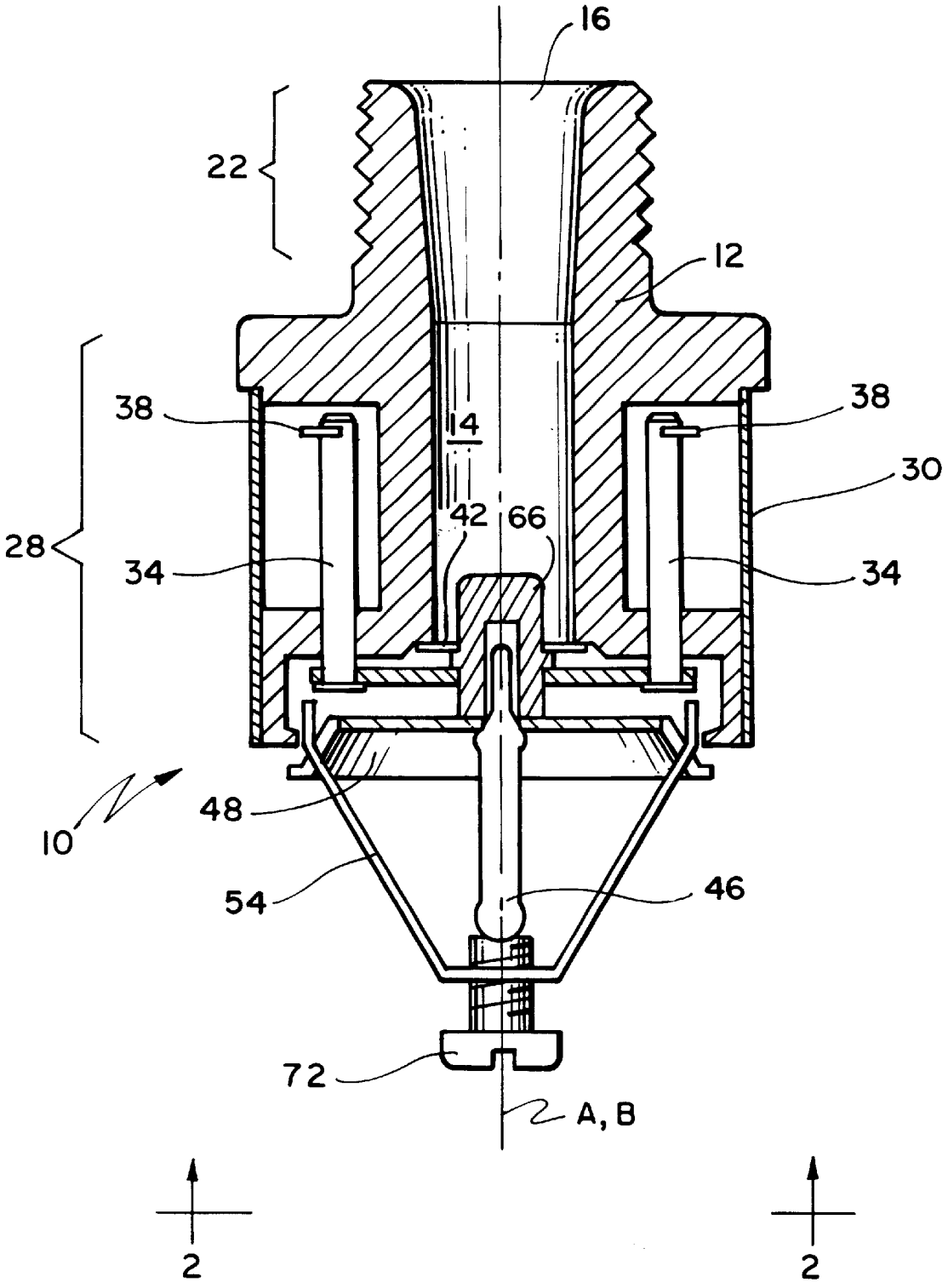
FIG. 1 is a side section view of a flush fire protection sprinkler of the invention in its standby condition, taken at the line 1—1 of FIG. 2.
Figure 2:
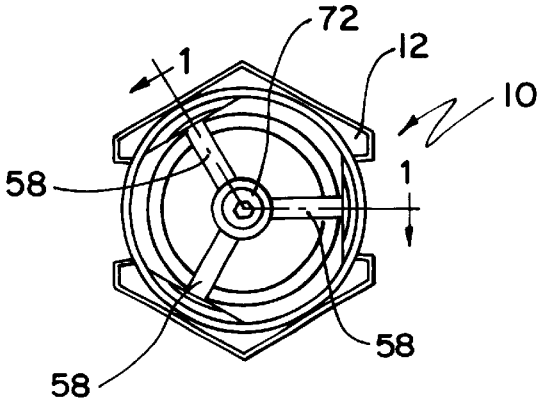
FIG. 2 is an end view of the flush fire protection sprinkler of FIG. 1, taken at the line 2—2 of FIG. 1.
Figure 3:
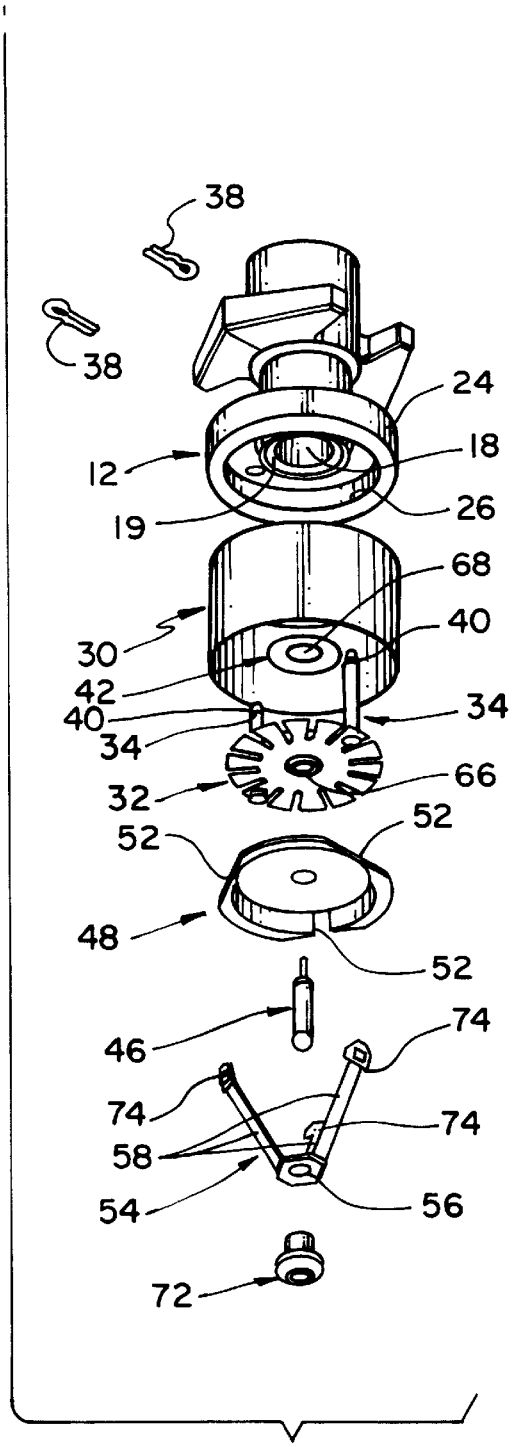
FIG. 3 is an exploded view of the flush fire protection sprinkler of FIG. 1.
Figure 8:
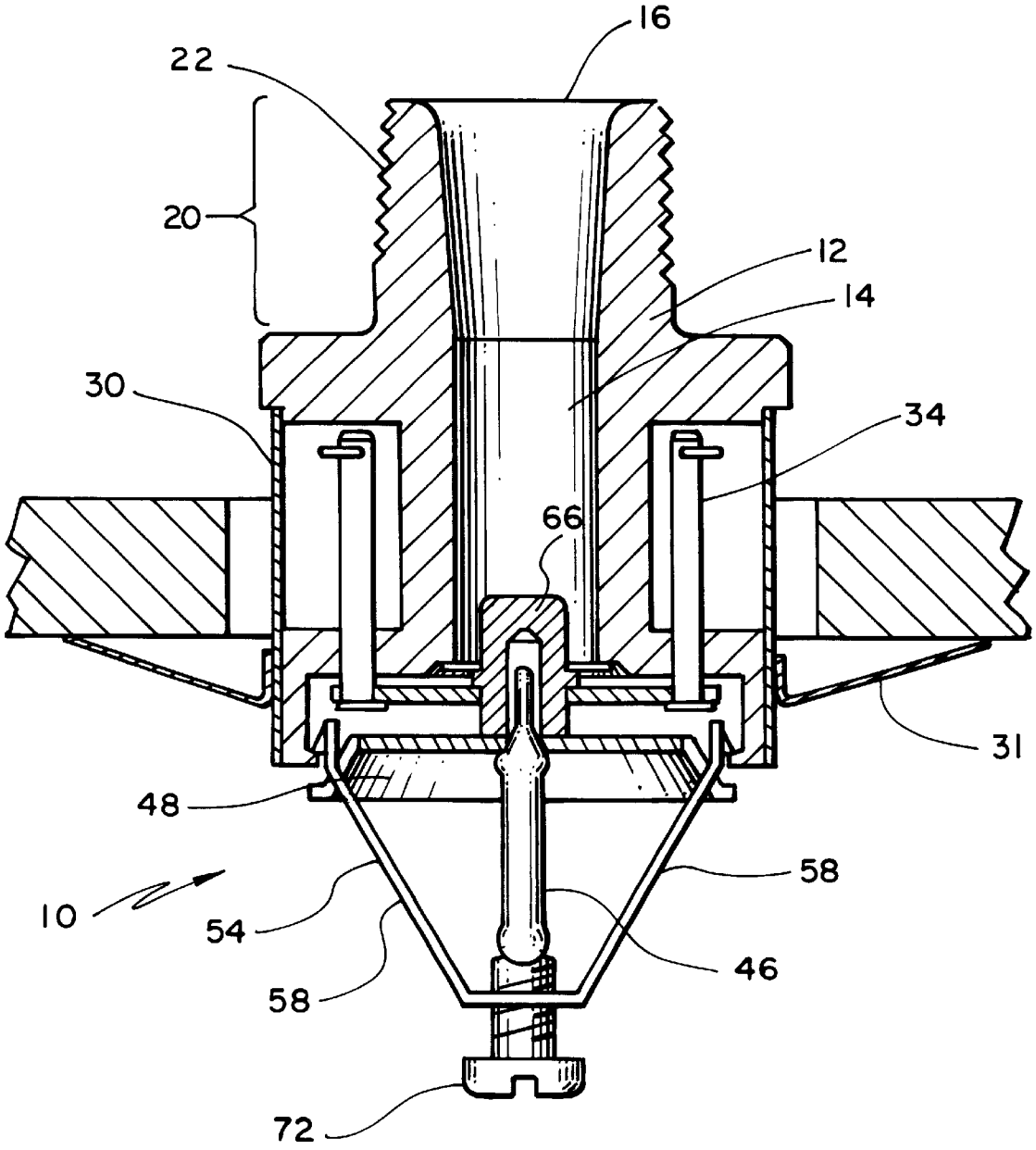
FIG. 8 is a somewhat diagrammatic side sectional view of the flush fire protection sprinkler of FIG. 1 mounted in a ceiling, with the escutcheon plate in place.

Referring to FIGS. 1, 2 and 3, a flush fire protection sprinkler 10 of the invention has a body 12, e.g. cast, machined brass (UNS C87800 or C83600), defining a passageway 14 extending along a sprinkler axis, A, between an inlet 16 and an outlet 18. An inlet portion 20 of the sprinkler body has threads 22 for threaded engagement with a system of fire protection piping (not shown) connected to a source of fire protection fluid, e.g., water, under pressure. A body rim or flange 24, with an inner circumferential lip 26, extends coaxially about the sprinkler outlet 18. An outlet portion 28 of the sprinkler body 12 is surrounded by a protective sleeve 30, e.g. plastic or other suitable material, with a slidable escutcheon 31 (FIG. 8), e.g. also plastic, light metal or other suitable material, adjustably engaged about the sleeve to cover the opening in the wall or ceiling.

A deflector 32 is mounted to the sprinkler body 12 by a pair of deflector arms 34, e.g. chrome plated phosphor bronze per UNS C51000 Grade A spring temper wire (#10 gauge), which extend in sliding engagement through holes 36 in the sprinkler body 12. The deflector 32 is secured to the body by deflector stop pins 38, e.g. also phosphor bronze Grade A wire spring temper 0.051 inch diameter, received in holes 40 provided for that purpose adjacent the free ends of the deflector arms 34.

Figure 9:
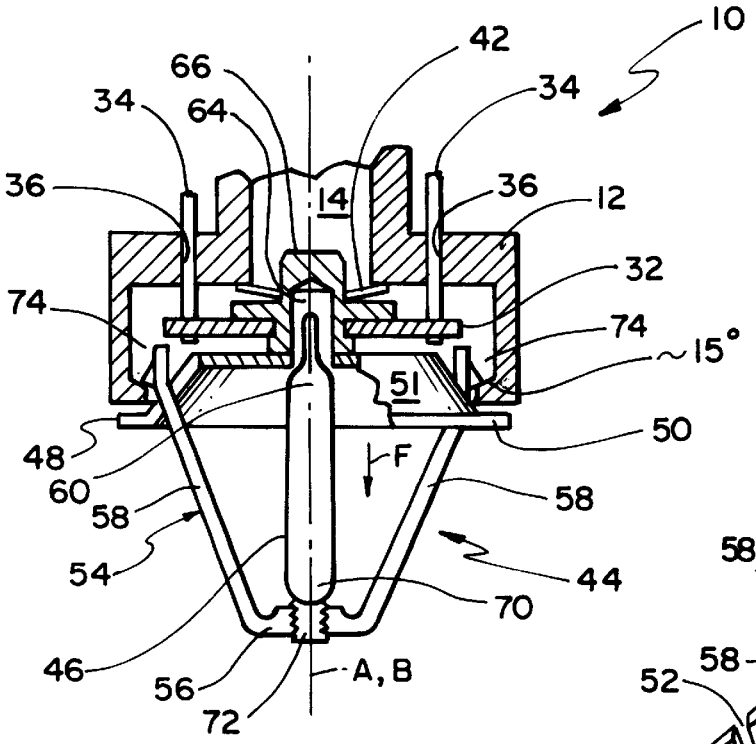
FIG. 9 is an enlarged side view, partially in section, of the flush fire protection sprinkler of FIG. 1 with the release assembly mounted to the sprinkler body in standby condition.

A resilient sealing ring 42, e.g. a Belleville washer-type spring sealing member with a coating of resilient TEFLON® (TEFLON® is a registered trademark of E.I. du Pont de Nemours and Company, Incorporated for its poly-tetra-fluoro-ethylene (PTFE) commercial product), is positioned between the deflector 32 and a seat surface 19 defined by the sprinkler body 12 about the outlet 18. The spring sealing member 42 is formed of ½ hard beryllium nickel (UNS N03360) about 0.019/0.016 inch (0.483/0.406 mm) thick, heat treated after forming to Rockwell hardness 85–89 (15N scale), with an outer diameter of about 0.504/0.496 inch (12.80/12.60 mm), a central aperture 68 having an inner diameter of about 0.272/0.260 inch (6.91/6.60), and a height of about 0.043/0.053 inch (1.1/0.9 mm). The spring sealing member 42 is held in sealing engagement with the seat surface 19 about the sprinkler outlet 18 by the deflector 32, urged by the bulb retainer assembly 44 (FIG. 9), for sealing off flow of fire protection fluid from the sprinkler outlet 18, as will be described more fully below.

The bulb retainer assembly 44 includes a thermally response element 46, e.g. a frangible bulb, a retaining plate member 48, and a bulb support 54 having a central hub 56 with multiple, e.g. three, elongated retainer fingers 58. The retaining plate member, e.g. formed of Type 316 stainless steel strip or other non-corrosive material, has a conical, upstanding rim 50 extending radially outward in the direction (arrow, F, (FIG. 9)) of flow of fire protection fluid from the sprinkler outlet 18 and defining multiple, e.g. three, slots 52. The surface 51 of the conical, upstanding rim 50 is sloped, e.g., at angle of about 120° to a plane perpendicular to the axis, A, of the sprinkler body, when assembled.

The frangible bulb 46 has a first (inner) end 60 engaging in a central aperture 62 in the retaining plate 48 and extending into an axially-aligned bore 64 of button 66, e.g. copper per UNS C14500, positioned in the central aperture 68 of the spring sealing member 42. The frangible bulb 46 also has a second (outer) end 70 which is engaged by an axially aligned pressure loading screw 72, e.g. Type 316 stainless steel, disposed in threaded engagement with the hub 56 of the bulb support 54.

Figure 4:
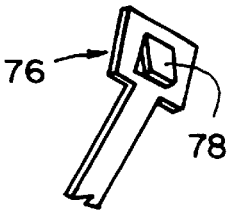
FIGS. 4, 5, 6 and 7 are perspective views of the free end of a release assembly finger showing different embodiments of release assembly retainer structure of the invention.
Figure 5:
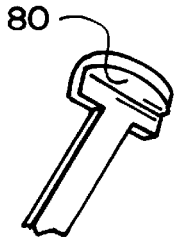
Figure 6:
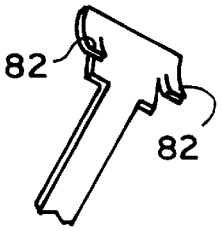
Figure 7:
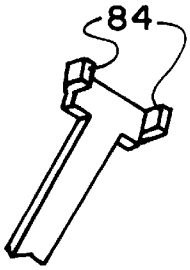

The bulb support 54 is formed of a stamping of spring tempered Type 301 stainless steel or other suitable non-corrosive material. The elongated retainer fingers 58 extend from the hub 56, spaced in the stamping, prior to forming, at angle of about 120°. The fingers 58 terminate in outer, enlarged fingertip portions 74, formed with engagement structure 76 for securely engaging the inner circumferential lip 26 of the rim 24 of the housing body 12. After forming, the elongated retainer fingers 58 are disposed at an angle to the bulb support axis, B, e.g. about 25°, with the enlarged fingertip portion 74 at the end of each retainer finger 58 approximately parallel to the bulb support axis, B. Referring to FIG. 4, in the preferred embodiment, the engagement structure 76 has the form of a pierced tab 78. Alternatively, the engagement structure may have the form of a bent lip 80 (FIG. 5); double tabs 82 (FIG. 6), or formed comers 84 (FIG. 7).

Referring to FIGS. 8, 9, 10 and 11, to assemble the flush fire protection sprinkler 10 of the invention, the elongated retainer fingers 58 of the bulb support 54 are engaged in the slots 52 defined in the conical, upstanding rim 50 of the retaining plate 48, with the enlarged fingertip portions 74 of each retainer finger 58 disposed radially outward beyond an outer surface 51 of the rim 50. In a region of each slot 52, the flange portion 53 of the conical, upstanding rim 50 is removed tangent to the intersection of the flange portion 53 with the outer surface 51. The retaining plate 48 is pressed against the deflector 32, partially compressing the spring sealing member 42. The first (inner) end 60 of frangible bulb 46 is engaged in the central aperture 62 in the retaining plate 48, into the axially-aligned bore 64 of the button 66 disposed in the central aperture 68 of the spring sealing member 42. The second (outer) end 70 of the frangible bulb 46 is engaged by the axially-aligned loading screw 72 disposed in threaded engagement through the central hub 56 of the bulb support 54. The loading screw 72 is tightened by rotation into the central hub 56, drawing the enlarged fingertip portions 74 at the outer tip ends of the elongated retainer fingers 58 along the outer surface 51 of the conical, upstanding rim 50 of the retaining plate 48. The outward slope of the rim outer surface 51 acts as a ramp surface, overcoming the radially inwardly directed spring bias (arrow, S) of the elongated retainer fingers 58 toward the bulb support axis, B (and the body axis, A). The enlarged fingertip portions 74 of the elongated retainer fingers 58 are spread radially outward, away from the deflector 32 and axis, A, until the engagement structure 76 of the enlarged fingertip portions 74 of each elongated retainer finger 58, e.g., in the preferred embodiment, a pierced tab 78 (FIG. 4), engages with the inner circumferential lip 26 of the body rim or flange 24. Further tightening of the loading screw 72 serves to press he retaining plate member 48 against the deflector 32, further compressing the spring sealing member 42 into sealing engagement upon the seat surface 19 of the sprinkler outlet 18.

Figure 11:
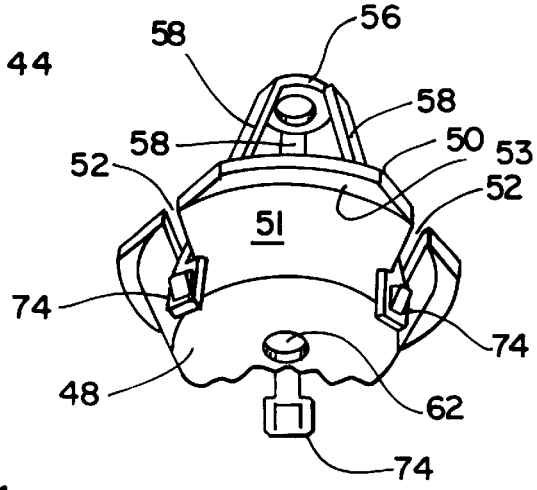
FIG. 11 is a perspective view of the release assembly after actuation of the flush fire protection sprinkler and release of the release assembly.
Figure 10:
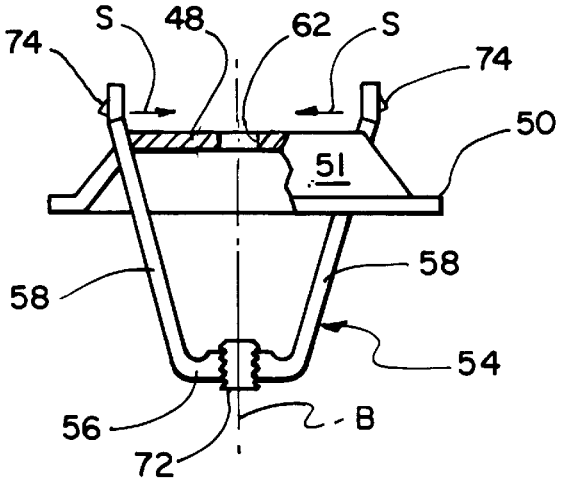
FIG. 10 is a similar enlarged side view, partially in section, of the release assembly after actuation of the flush fire protection sprinkler and release of the release assembly.
Figure 12:
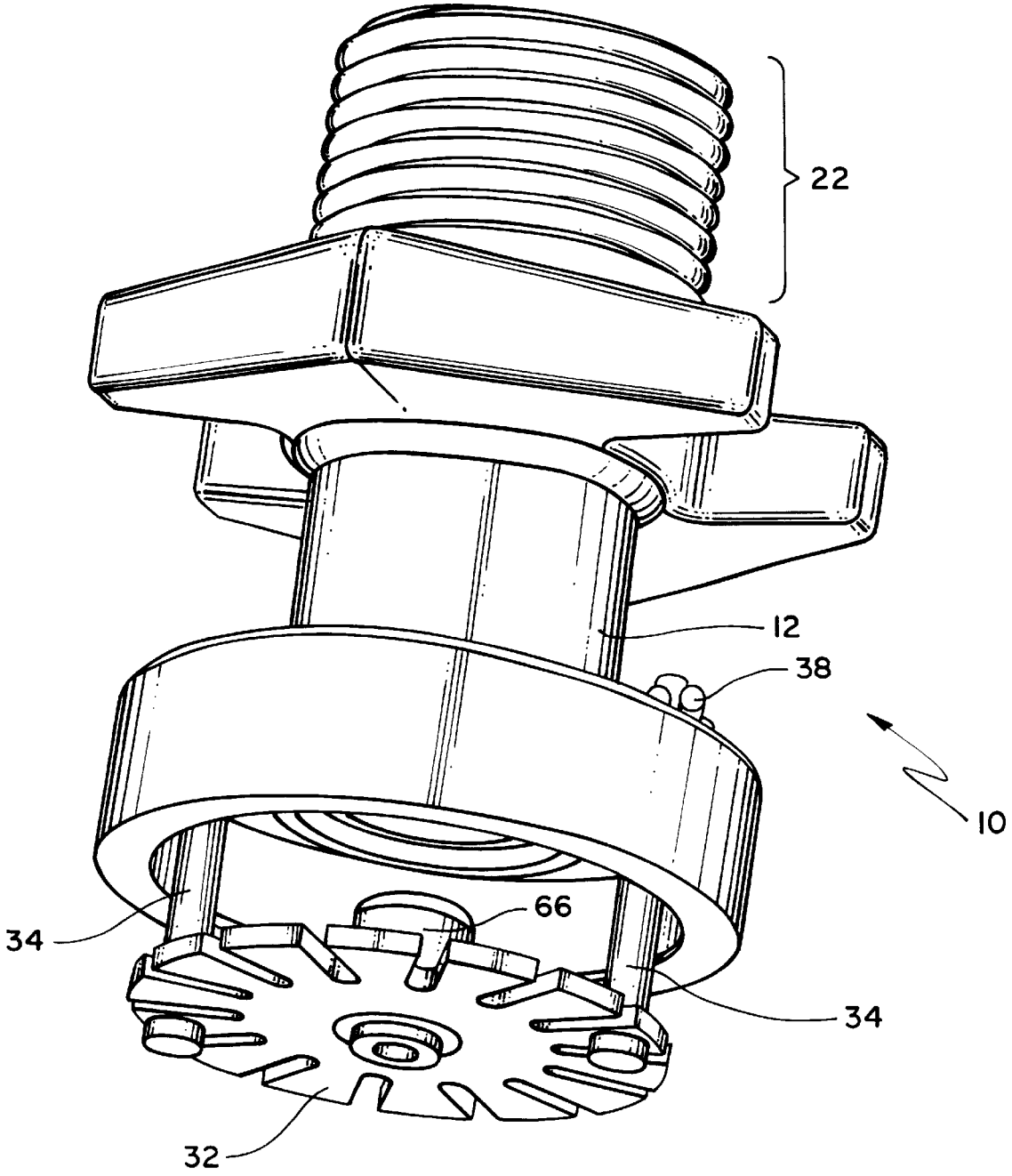
FIGS. 12 and 13 are perspective and side sectional views, respectively, of the flush fire protection sprinkler of FIG. 1 in its active condition, with the deflector extended.
Figure 13:
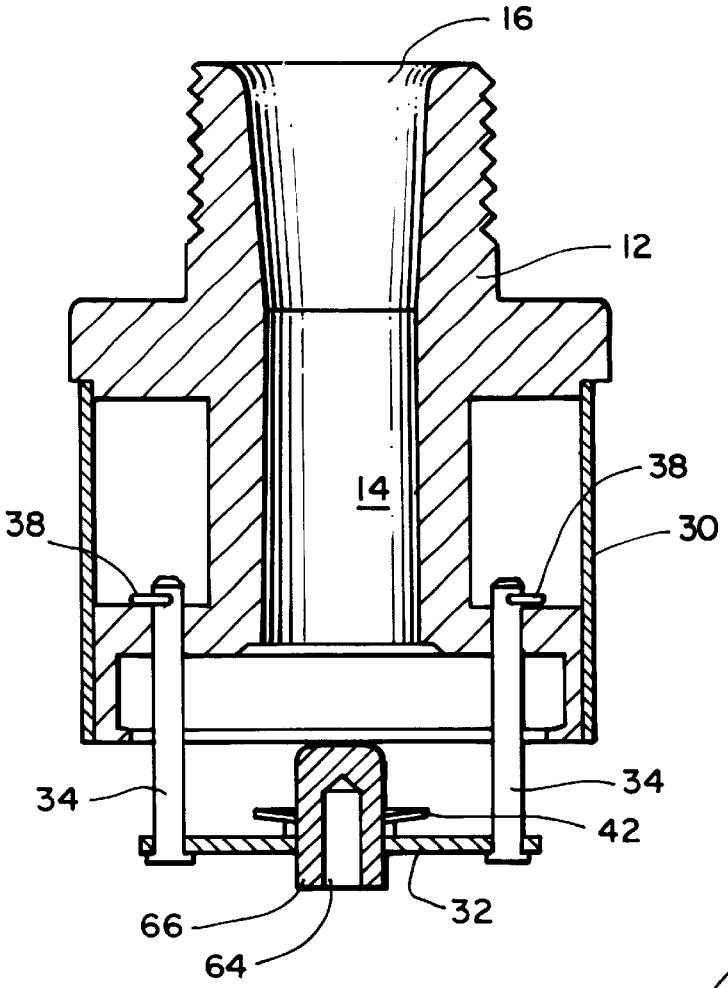

Referring to FIGS. 10 and 11, upon exposure to a predetermined elevated temperature, e.g. indicative of a fire condition, the frangible bulb 46 bursts, releasing fire protection fluid to flow from the sprinkler outlet 18. The retaining plate member 48 is urged outward, away from the sprinkler body 12, under force of the spring sealing member 42 and pressure of fire protection fluid flowing from the sprinkler outlet 18. The outward movement of the retaining plate member 48 allows the elongated retainer fingers 58 of the bulb support 54 to contract radially inward, under influence of the spring biasing force (arrows, S), to release the engagement structure 76 on the enlarged fingertip portions 74 of the elongated retainer finger 58 from engagement with the inner circumferential lip 26 of the body rim 24. The bulb retainer assembly 44 then drops away, and the deflector arms 34, under pressure of flow of fire protection fluid from the sprinkler outlet 18 against the deflector 32, slide in body holes 36 (until the deflector stop pins 38 at the ends of the deflector arms 34 are engaged with the body 12), to move the deflector 32 to its extended operating position (FIGS. 12 and 13), to distribute the flow of fire protection fluid over the area to be protected.

A number of embodiments of the invention have been described. Nevertheless, it will be understood that various modifications may be made without departing from the spirit and scope of the invention. For example, other types of thermally responsive elements may be employed, e.g., a fusible link.

Figure 14:
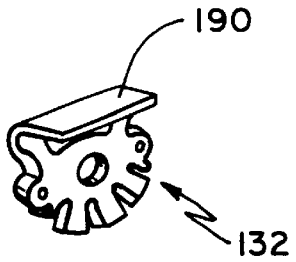
FIGS. 14, 15 and 16 are perspective views showing different horizontal sidewall-type configurations for flush fire protection sprinklers of the invention.
Figure 16:
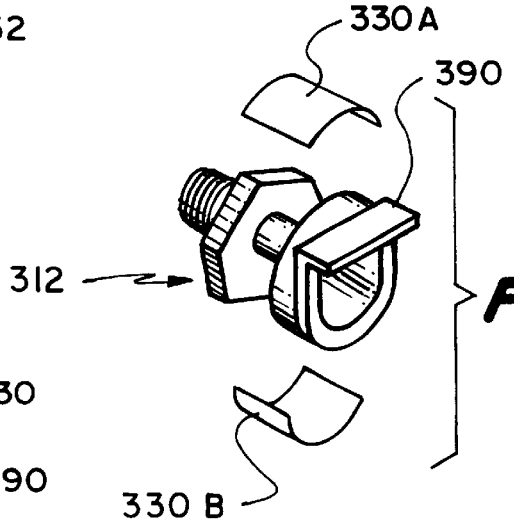
Figure 15:
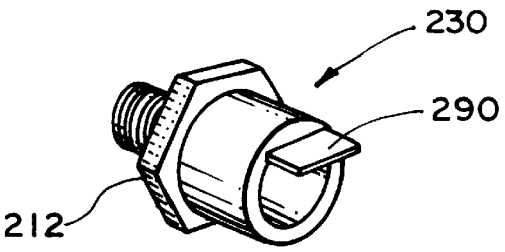

Also, referring to FIGS. 14, 15, and 16, horizontal sidewall-type configurations of flush fire protection sprinklers of the invention may have a deflector shelf positioned for deflecting flow of fire protection fluid from the outlet generally downward, over the area to be protected. For example, a flush fire protection sprinkler of the invention with horizontal sidewall-type configuration may have a deflector 132 with an internal shelf 190 (FIG. 14). Alternatively, the flush fire protection sprinkler with horizontal sidewall-type configuration may have a body 212 engaged by a protective sleeve 230 with a shelf extension 290 (FIG. 15), or a modified body casting 312 formed with a shelf 390 and having protective sleeve formed of separable components 330A, 330B (FIG. 16).

Accordingly, other embodiments are within the scope of the following claims.

What is claimed is:

1. A flush fire protection sprinkler comprising:

a body defining a passage having an inlet for connection to a source of fire protection fluid under pressure and an outlet for delivery of fire protection fluid toward a region to be protected, said body defining a seat about said outlet and a rim coaxial with said outlet and having an inner circumferential lip, said flush fire protection sprinkler having a first, standby condition with said outlet closed to flow and a second, active condition with said outlet open to flow, a sealing member engaged upon said seat, and a thermally responsive element assembly, comprising:

a plate member having a conical upstanding rim extending radially outward in a direction of fire protection fluid flow from said outlet and defining a plurality of slots extending radially inward from an outer edge of said conical, upstanding rim, a retaining member having a hub and a plurality of elongated retainer fingers terminating in enlarged fingertip portions defining engagement structure, said elongated retainer fingers having a radially inward bias, toward a hub axis, and engaged in said plurality slots, with said enlarged fingertip portions disposed radially outside an outer surface of said conical, upstanding rim, a thermally responsive element disposed between said plate member and said hub, said thermal responsive element actuating in response to a heat condition above a predetermined temperature, and a pressure loading element mounted to said hub for applying pressure to said thermally responsive element, initial adjustment of said pressure loading element drawing said hub relatively away from said plate member, with said outer surface of said conical upstanding rim urging said enlarged fingertip portions of said elongated retainer fingers radially outward to bring said engagement structure of said enlarged fingertip portions into engagement with said inner circumferential lip, further adjustment of said pressure loading element pressuring said sealing member in sealing engagement upon said seat, said thermally responsive element, in a heat condition above said predetermined temperature, actuating to allow pressure of fire protection fluid flow from said outlet to urge said plate member away from said outlet, permitting said elongated retainer fingers to contract toward said hub axis under said radially inward bias, disengaging said engagement structure of said enlarged fingertip portions from said inner circumferential lip, said thermally responsive element assembly thus disengaging from said body to move away from said outlet.

2. The flush fire protection sprinkler of claim 1, further comprising: a deflector mounted to said body, said deflector, in said standby condition of said flush fire protection sprinkler, being positioned to urge said sealing member into sealing engagement upon said seat, and said deflector, in said active condition of said flush fire protection sprinkler, being positioned to deflect flow of fire protection fluid from said outlet over an area of the region to be protected.

3. The flush fire protection sprinkler of claim 2, wherein said deflector is mounted upon deflector arms disposed in sliding engagement with said body.

4. The flush fire protection sprinkler of claim 1, wherein said sealing member is spring sealing member.

5. The flush fire protection sprinkler of claim 4, wherein said spring sealing member is a Belleville washer-type spring sealing member.

6. The flush fire protection sprinkler of claim 5, wherein said Belleville washer-type spring sealing member has a resilient coating of PTFE.

7. The flush fire protection sprinkler of claim 4, 5, or 6, wherein said spring sealing member, upon actuation of said thermally responsive element, urges said plate member away from said outlet.

8. The flush fire protection sprinkler of claim 1, wherein said plurality of elongated retainer fingers comprises three elongated retainer fingers.

9. The flush fire protection sprinkler of claim 1, wherein said retaining member is formed of a non-corrosive material.

10. The flush fire protection sprinkler of claim 9, wherein said non-corrosive material is stainless steel.

11. The flush fire protection sprinkler of claim 1, 8, 9, or 10, wherein said retaining member is spring tempered.

12. The flush fire protection sprinkler of claim 1, 8, 9 or 10, wherein said retaining member is a metal stamping.

13. The flush fire protection sprinkler of claim 12, wherein said retaining member is spring tempered.

14. The flush fire protection sprinkler of claim 1, wherein said plate member is formed of a non-corrosive material.

15. The flush fire protection sprinkler of claim 14, wherein said non-corrosive material is stainless steel.

16. The flush fire protection sprinkler of claim 1, 14, or 15, wherein said plate member is a metal stamping.

17. The flush fire protection sprinkler of claim 1, wherein said thermally responsive element is a frangible bulb that, in a heat condition above said predetermined temperature, bursts to allow pressure of fire protection fluid flow from said outlet.

18. The flush fire protection sprinkler of claim 1, wherein said engagement structure comprises a pierced tab.

19. The flush fire protection sprinkler of claim 1, wherein said engagement structure comprises a bent lip.

20. The flush fire protection sprinkler of claim 1, wherein said engagement structure comprises double tabs.

21. The flush fire protection sprinkler of claim 1, wherein said engagement structure comprises formed corners.

22. The flush fire protection sprinkler of claim 1 in a configuration for mounting as a pendent-type fire protection sprinkler.

23. The flush fire protection sprinkler of claim 1 in a configuration for mounting as a sidewall horizontal-type fire protection sprinkler.

24. The flush fire protection sprinkler of claim 23 in a configuration for mounting as a sidewall horizontal-type fire protection sprinkler and further comprising a generally horizontal shelf deflector element.

25. A flush fire protection sprinkler comprising:

a body defining a passage having an inlet for connection to a source of fire protection fluid under pressure and an outlet for delivery of fire protection fluid toward a region to be protected, said body defining a seat about said outlet, said flush fire protection sprinkler having a first, standby condition with said outlet closed to flow and a second, active condition with said outlet open to flow, a sealing member engaged upon said seat, and a thermally responsive element assembly, comprising a spring member having a plurality of elongated retainer fingers retaining a thermally responsive element that actuates in response to a heat condition above a predetermined temperature, said thermally responsive element, in a heat condition above said predetermined temperature, that actuates to permit said elongated retainer fingers to disengage from said body to move away from said outlet, releasing said sealing member from engagement upon said seat.

26. The flush fire protection sprinkler of claim 25, further comprising: a deflector mounted to said body, said deflector, in said standby condition of said flush fire protection sprinkler, being positioned to urge said sealing member into sealing engagement upon said seat, and said deflector, in said active condition of said flush fire protection sprinkler, being positioned to deflect flow of fire protection fluid from said outlet over an area of the region to be protected.

27. The flush fire protection sprinkler of claim 26, wherein said deflector is mounted upon deflector arms disposed in sliding engagement with said body.

28. The flush fire protection sprinkler of claim 25, wherein said sealing member is spring sealing member.

29. The flush fire protection sprinkler of claim 28, wherein said spring sealing member is a Belleville washer-type spring sealing member.

30. The flush fire protection sprinkler of claim 29, wherein said Belleville washer-type spring sealing member has a resilient coating of PTFE.

31. The flush fire protection sprinkler of claim 25, wherein said plurality of elongated retainer fingers comprises three elongated retainer fingers.

32. The flush fire protection sprinkler of claim 25, wherein said spring member is formed of a non-corrosive material.

33. The flush fire protection sprinkler of claim 32, wherein said non-corrosive material is stainless steel.

34. The flush fire protection sprinkler of claim 25, 31, 32 or 33, wherein said spring member is a metal stamping.

35. The flush fire protection sprinkler of claim 25, wherein said thermally responsive element is a frangible bulb that, in a heat condition above said predetermined temperature, bursts to allow pressure of fire protection fluid flow from said outlet.

36. The flush fire protection sprinkler of claim 25 in a configuration for mounting as a pendent-type fire protection sprinkler.

37. The flush fire protection sprinkler of claim 25 in a configuration for mounting as a sidewall horizontal-type fire protection sprinkler.

38. The flush fire protection sprinkler of claim 37 in a configuration for mounting as a sidewall horizontal-type fire protection sprinkler and further comprising a generally horizontal shelf deflector element.

39. A flush fire protection sprinkler comprising:

a body defining a passage having an inlet for connection to a source of fire protection fluid under pressure and an outlet for delivery of fire protection fluid toward a region to be protected, said body defining a seat about said outlet and a rim coaxial with said outlet and having an inner circumferential lip, said flush fire protection sprinkler having a first, standby condition with said outlet closed to flow and a second, active condition with said outlet open to flow, a sealing member engaged upon said seat, a deflector mounted to said body, said deflector, in said standby condition of said flush fire protection sprinkler, being positioned to urge said sealing member into sealing engagement upon said seat, and said deflector, in said active condition of said flush fire protection sprinkler, being positioned to deflect flow of fire protection fluid from said outlet over an area of the region to be protected, and a thermally responsive element assembly, comprising:

a plate member having a conical upstanding rim extending radially outward in a direction of fire protection fluid flow from said outlet and defining a plurality of slots extending radially inward from an outer edge of said conical, upstanding rim, a retaining member having a hub and a plurality of elongated retainer fingers terminating in enlarged fingertip portions defining engagement structure, said elongated retainer fingers having a radially inward bias, toward a hub axis, and engaged in said plurality slots, with said enlarged fingertip portions disposed radially outside an outer surface of said conical, upstanding rim, a thermally responsive element disposed between said plate member and said hub, said thermal responsive element actuating in response to a heat condition above a predetermined temperature, and a pressure loading element mounted to said hub for applying pressure to said thermally responsive element, initial adjustment of said pressure loading element drawing said hub relatively away from said plate member, with said outer surface of said conical upstanding rim urging said enlarged fingertip portions of said elongated retainer fingers radially outward to bring said engagement structure of said enlarged fingertip portions into engagement with said inner circumferential lip, further adjustment of said pressure loading element pressuring said sealing member in sealing engagement upon said seat, said thermally responsive element, in a heat condition above said predetermined temperature, actuating to allow pressure of fire protection fluid flow from said outlet to urge said plate member away from said outlet, permitting said elongated retainer fingers to contract toward said hub axis under said radially inward bias, disengaging said engagement structure of said enlarged fingertip portions from said inner circumferential lip, said thermally responsive element assembly thus disengaging from said body to move away from said outlet.

* * * * *